US006255771B1

(12) United States Patent
Jones et al.

(10) Patent No.: US 6,255,771 B1
(45) Date of Patent: Jul. 3, 2001

(54) FLASHOVER CONTROL STRUCTURE FOR FIELD EMITTER DISPLAYS AND METHOD OF MAKING THEREOF

(75) Inventors: Gary W. Jones, Lagrangeville; Steven M. Zimmerman, Pleasant Valley; Webster E. Howard, Fishkill; Stewart Lloyd, Hopewell Junction, all of NY (US)

(73) Assignee: eMagin Corporation, Hopewell Junction, NY (US)

( * ) Notice: Subject to any disclaimer, the term of this patent is extended or adjusted under 35 U.S.C. 154(b) by 0 days.

(21) Appl. No.: 08/985,222

(22) Filed: Dec. 4, 1997

(51) Int. Cl.[7] ..... H01J 1/62; H01J 63/04; H01J 1/46; H01J 21/10

(52) U.S. Cl. ..... 313/495; 313/309; 313/336; 313/351; 313/306; 313/307; 313/308

(58) Field of Search ..... 313/306–309, 313/336, 351, 495–97; 445/24, 50, 51

(56) References Cited

U.S. PATENT DOCUMENTS 5,529,524 * 6/1996 Jones ..... 445/24
5,534,743 * 7/1996 Jones et al. ..... 313/309
5,548,181 * 8/1996 Jones ..... 313/495 X
5,619,097 * 4/1997 Jones ..... 313/495
5,663,608 * 9/1997 Jones et al. ..... 313/309
5,688,158 * 11/1997 Jones et al. ..... 445/50

* cited by examiner

*Primary Examiner*—Nimeshkumar D. Patel
*Assistant Examiner*—Mack Haynes
(74) *Attorney, Agent, or Firm*—David R. Yohannan; Collier Shannon Scott, PLLC

(57) ABSTRACT

A field emitter device including an insulator structure provided on an upper gate line layer of the device. The insulator structure may surround groups of emitters arranged on adjacent gate lines, groups of emitters arranged on the same gate lines, and/or entire regions of a larger array of field emitters. The insulator structure may reduce the occurrence of flashovers to and from the gate lines and emitters when the field emitter device is used in a display. The insulator structure may also enhance the focus of electrons emitted by the field emitter device on the display screen. Focus may be further enhanced by the addition of a resistive coating on the insulator structure. Methods of making the insulator structure and resistive coating are also disclosed.

19 Claims, 7 Drawing Sheets

FLASHOVER CONTROL STRUCTURE FOR FIELD EMITTER DISPLAYS AND METHOD OF MAKING THEREOF

FIELD OF THE INVENTION

The present invention relates to field emitter arrays having an insulator structure surrounding each field emitter, groups of field emitters, or the perimeter of a field emitter group array. The invention also relates to methods of making such insulator structures.

BACKGROUND OF THE INVENTION

Microminiature field emitters are well known in the microelectronics art. These microminiature field emitters are finding widespread use as electron sources in microelectronic devices. For example, field emitters may be used as electron guns in flat panel displays for use in aviation, automobiles, workstations, laptops, head wearable displays, heads up displays, outdoor signage, or practically any application for a screen which conveys information through light emission. Field emitters may also be used in non-display applications such as power supplies, printers, and X-ray sensors.

When used in a display, the electrons emitted by a field emitter are directed to an cathodoluminescent material. These display devices are commonly called Field Emitter Displays (FEDs). A field emitter used in a display may include a microelectronic emission surface, also referred to as a "tip" or "microtip", to enhance electron emissions. Conical, pyramidal, curved and linear pointed tips are often used. Alternatively, a flat tip of low work function material may be provided. An emitting electrode typically electrically contacts the tip. An extraction electrode or "gate" may be provided adjacent, but not touching, the field emission tip, to form an electron emission gap therebetween. Upon application of an appropriate voltage between the emitting electrode and the gate, quantum mechanical tunneling, or other known phenomena, cause the tip to emit electrons. In microelectronic applications, an array of field emission tips may be formed on the horizontal face of a substrate such as a silicon semiconductor substrate, glass plate, or ceramic plate. Emitting, electrodes, gates and other electrodes may also be provided on or in the substrate as necessary. Support circuitry may also be fabricated on or in the substrate.

The FEDs may be constructed using various techniques and materials, which are only now being perfected. Preferred FED's may be constructed of semiconductor materials, such as silicon. There are two predominant processes for making field emitters; "well first" processes, and "tip first" processes. In well first processes, such as a Spindt process, wells are first formed in a material, and tips are later formed in the wells. In tip first processes, the tips are formed first, and the wells are formed around the tips. There are multitudes of variations of both the well first and the tip first processes. The present invention is equally applicable to field emitters made by any process, whether it be well first, tip first, or some other type of process.

The electrical theory underlying the operation of an FED is similar to that for a conventional CRT. Electrons supplied by a cathode are emitted from the tips in the direction of the display surface. The emitted electrons strike phosphors on the inside of the display which excites the phosphors and causes them to momentarily luminesce. An image is produced by the collection of luminescing phosphors on the inside of the display screen. This process is a very efficient way of generating a lighted image.

In a CRT, a single electron gun is provided to generate all of the electrons which impinge on the display screen. A complicated aiming device, usually comprising high power consuming electromagnets, is required in a CRT to direct the electron stream towards the desired screen pixels. The combination of the electron gun and aiming device behind the screen necessarily make a CRT display. prohibitively thick.

FEDs, on the other hand, may be relatively thin. Each pixel of an FED has its own electron source, typically an array or grouping of emitting microtips. The voltage difference between the cathode and the gate causes electrons to be emitted from the microtips which are in electrical proximity with the cathode. The FEDs are thin because the microtips, which are the equivalent of an electron gun in a CRT, are extremely small. Further, an FED does not require an aiming device, because each pixel has its own electron gun (i.e. an array of emitters) positioned directly behind it. The emitters need only be capable of emitting electrons in a direction generally normal to the FED substrate.

With reference to FIG. 1, a basic FED emitter device 10 may include a glass substrate 100 with a cathode line 200 provided thereon. A current limiter 300 may be provided on the cathode line 200, and emitters 500 may be provided on the current limiter 300. The current limiter 300 may include an insulating or near insulating layer 310 and a resistive layer 350. By way of example, the resistive layer 350 may comprise an 8%–50% chromium—silicon oxide mixture.

The emitters 500, are preferably shaped to have a fine point 510 which enhances the electron emission capability of the emitters. The emitters 500 may be provided in wells 410 formed in a layer of insulator material 400. A gate line 600 may be provided over the insulator layer 500 with holes in the gate line above the emitters 500. The edges of the holes in the gate lines may be referred to as the gates 610 for the respective emitters. Plural emitters 500 may be arranged into groups 520 having a square, rectangular, circular, or some other geometric pattern as viewed from above.

With reference to FIG. 2, a plan view of several groups 520 of emitters are shown as arranged over adjacent cathode lines 200 and in adjacent gate lines 600. The cross section A—A identified in FIG. 2 can be viewed in detail in FIG. 1. The cathode lines or columns 200 and the gate lines or rows 600 typically run across the display perpendicular to one another. Each grouping (or pixel) 520 may contain hundreds or even thousands of individual emitters 500. Only four (4) emitters are shown per grouping in FIG. 2 for ease of illustration. Plural cathode lines 200 may be arranged in parallel vertical columns, and plural gate lines 600 may be arranged in parallel horizontal rows to form a matrix of "columns" and "row".

The emitters 500 of the grouping 520 may emit electrons when an intersecting cathode line 200 and gate line 600 are both activated. Activation of the gate lines may be achieved simply by periodically applying a voltage to each of the gate lines in sequence in accordance with a raster scan using simple drivers. For example, in a 480 row FED, each gate line or row may expect to be "on" for $1/480$ of the time. Activation of the cathode line is produced by selectively lowering the voltage of the cathode line to increase the potential difference between the cathode line and the gate line or row. The selective decrease in the cathode line voltage allows for the provision of a gray scaled display with more colors than might be expected. Drivers with gray level capability are only required for the cathode lines because they are the only lines which require selective variation of the voltages thereon.

Referring back to FIG.1, emission of electrons from the tips 510 is brought about by generating an electrical field at the tips which is conducive to electron emission. The fine point of the tips concentrates the electric field at the tips and enhances the likelihood that electrons will tunnel from the tips in a generally upward direction. To achieve emission, this electric field must be generated in conjunction with the application of a particular voltage to the cathode line 200 underlying the emitter tips 510. The electrical field may be generated by increasing the positively charged voltage applied to the gate line 600. Consequently, the electrons are induced to tunnel from the tips 510 and travel upwards under the influence of the positively charged gates 610 toward a much more positively biased anode 700 (not shown in FIG. 1).

With reference to FIG. 3, once emitted, and before reaching the gates 610, the electrons may come under the influence of a highly positively biased anode 700 above the field emitter. Typically, the anode 700 of a display may be provided by a thin conductor layer. A layer of phosphors 800, consisting of individual phosphorescent grains 810, may be provided on a second glass substrate 900 adjacent the anode 700. Electrons attracted to the anode 700 strike the phosphors, causing them to glow, and light emitted through the top side 910 of the glass substrate may be viewed as part of an image, text, etc.

In order to operate a display, the space between the field emitters 500 and the anode 700 should be evacuated. Typically, this space may be on the order of a 2 millimeter gap. The glass substrate 100 underlying the emitters 500 and the glass substrate 900 supporting the phosphors 800 may be sealed to one another along their respective edges using a glass frit 910. After being sealed, the space between the two glass substrates, 100 and 900, is evacuated of air or gas and sealed off from the outside atmosphere.

Because the materials within the FED (such as phosphors) are very likely to outgas over time, a getter (not shown) may be provided near or at the outer perimeters of the glass substrates, 100 and 900, and/or adjacent the inner surface of the glass frit. The getter is a substance which may absorb gas molecules that come in contact with it as a result of outgassing from materials within the FED.

It is imperative to the operation of the FED to capture as many of the outgassed gas molecules as possible. The reason being that these gas molecules may become ionized as a result of being bombarded by the electrons in the FED. The ionized gas molecules may provide an electrical path for flashovers (discharges) between adjacent gate lines 600, between emitter tips 510 and gates 610, and even between gate lines 600 and the anode 700. In FEDs in which the potential between the anode 700 and the cathode lines 200 is in the range of thousands of volts, such flashover may be catastrophic to the device 10. Even if the flashover is not initially catastrophic, flashover may result in vaporization of materials within the FED, resulting in the production of additional gas molecules therein, and sowing the seeds for a future flashover.

Prior to the present invention, adequate flashover control has been virtually nonexistent. The primary method of combating flashover between the gate lines 600, the emitters 500, and the anode 700 has been to reduce the operating potential between the anode 700 and the cathode line 200. By decreasing the potential to levels of only a few hundred volts, the occurrence of flashover may be reduced, although it is far from eliminated. This reduction in the potential, however, has serious repercussions on the longevity of the FED, since most phosphor degradation occurs in proportion to the total number of electrons having struck the phosphor, and not in proportion to the total power or light output of the phosphor. High anode voltages, in excess of 5,000 volts, permit aluminized phosphor films to be used which increase efficiency and reduce the rate of fixed patterns being burned into the phosphor screen.

Ise, U.S. Pat. No. 5,448,133 (issued Sep. 5, 1995) for a Flat Panel Field Emission Display Device with a Reflective Layer, touts the advantages of reducing the potential between the anode and cathode in a FED. Ise states that a reduction of the operating voltage of a FED will reduce power consumption, which reduces battery size, and enables portability. Ise states that presently the low end threshold for anode to cathode potential is about 400 volts. Ise reports operation of his FED at as low as 100 volts of cathode to anode potential.

Reduction of the cathode to anode potential, as suggested by Ise, may significantly reduce the lifespan of an FED when conventional CRT color phosphors are used. With reference to FIG. 3, by reducing the anode voltage (i.e. the potential), the acceleration of the electrons towards the anode 700 is significantly reduced. The lower acceleration means that the electrons have less energy when they strike the individual phosphor particles 810. As a consequence of having less kinetic energy, the electrons do not penetrate very far into the phosphor particles upon striking them. Since none of the electrons penetrate very deeply into the phosphors, there is a concentration of electron collisions in the outer perimeters of the lower most phosphor particles 810. This concentration of electron collisions results in thermal degradation of the outer phosphor layer. The phosphors may degrade rapidly, and to such an extent, that they no longer luminesce sufficiently from the impingement of electrons from the emitters. This type of phosphor degradation can reduce display lifespan to only a few hundreds of hours when the end of lifespan is the point when a phosphor produces less than 80% of its initial light output given a fixed input current or power. This degradation may be especially important where frequently repeated patterns are used which may be "burned in" to the phosphor of the display. This short of a lifespan is not practical for most display applications. The thermal degradation of the phosphors may even generate unwanted substances, such as liquid or gaseous acids, which may migrate and foul the emitters underlying the phosphor layer 800.

An additional restriction imposed by the use of lower anode voltages is that the anode must physically be located behind the phosphor particles relative to the incoming electrons. Unlike the arrangement shown in FIG. 3, the anode 700 needs to be between the phosphor layer 800 and the glass substrate 900 when low anode voltages are utilized. The reduced anode voltage requires that the anode 700 be placed behind the phosphor layer 800 because the electrons do not have the necessary kinetic energy to fully penetrate the anode to reach the phosphor layer.

As a result of being placed behind the phosphors, a reflective anode, such as aluminum cannot be used to reflect photons which do not initially travel towards the glass substrate 900. If the aluminum anode can be placed over the inside of the phosphor layer 700 then it may be used to reflect light towards the viewer; thereby increasing the contrast and energy efficiency of the FED.

In a different approach, Applicants achieved some level of flashover control using the field emitter arrays disclosed in Jones, U.S. Pat. No. 5,534,743 (Jul. 9, 1996) for Field Emission Display Devices, and Field Emission Electron Beam Source and Isolation Structure Components Therefor, which is hereby incorporated herein by reference in its entirety. The field emitter arrays disclosed in the '743 patent may include one or more thin layers of insulator material overlying the gate rows to protect against flashover and partially deflect electrons. The thin insulator layers disclosed in the '743 patent, however, provided inadequate flashover control because thin layers are prone to pinhole defects and areas of low breakdown strength.

There is another, related problem which is presently being faced by FED manufacturers. In many FED's, the gate lines may be exposed at one or both ends. The exposure of the gate lines at some point becomes necessary to allow for connection of the gate lines to an outside voltage source or to a resistive path. Gate lines may be more exposed than column (cathode) lines because they are generally provided on top of the field emitter array. To date, the occurrence of flashovers at the ends of the gate lines has not been satisfactorily addressed. Even if flashovers do not occur at the gate line ends, the gate lines may still develop a significant charge with no place to dump it, creating the ideal condition for an undesired flashover in the central portion of the gate lines (i.e. in the vicinity of the field emitters).

Accordingly, there is a need for methods and apparatus for reducing the occurrence of flashover, without reducing the level of anode voltages. There is also a need for methods and apparatus for reducing the magnitude of damage suffered from the occurrence of flashovers during the initial burn-in and operation of the device. Furthermore, there is a need for methods and apparatus for dissipating excessive charge built up on the gate lines in an FED.

Another problem which has been encountered in the operation of FED's relates to the scattering of the electrons emitted from the emitter tips. With renewed reference to FIG. 3, emitted electrons preferably impinge on a phosphor particle 810 which is directly above the tip from which the electron is emitted. Some portion of the emitted electrons may, however, deviate slightly from a wholly vertical pathway. Accordingly, there may be some horizontal dispersion at the phosphor layer 800 of the electrons emitted from a single tip.

Field emission displays generally depend upon proximity focusing to keep the electrons from one pixel from spreading to another pixel when they arrive at the screen. The degree of spreading in this case is determined almost completely by the separation between emitters and screen and by the relationship between the screen voltage and the gate voltage; the larger the ratio of screen voltage to gate voltage, the smaller the spot size. For high resolution displays, this focusing may not be sufficient, so various schemes have been developed for incorporating an additional electrode to provide further focusing.

One scheme is to provide a second gate electrode, insulated from the first but situated everywhere over the first gate. This results in a focus electrode for each individual emitter, but such a structure is difficult to fabricate and can be expected to result in a lower yield in manufacturing. Examples of focusing grids are provided by Doan, U.S. Pat. Nos. 5,186,670 (Feb. 16, 1993) and 5,259,799, both for Method to Form Self-Aligned Gate Structures and Focus Rings. These focusing grids tend to reduce the horizontal scattering of emitted electrons by opposing the horizontal motion of the electrons after the electrons come under the accelerating influence of the anode. The focusing grids may be charged to a specific voltage by connecting them to a voltage source. The negative charge on the grid in a horizontal plane through which the electrons travel, tends to keep the electrons moving in primarily a vertical direction. The requirement of maintaining the focusing grids at a specific voltage, however, adds complexity and expense to the manufacturing and operation of FED's with focusing grids. Furthermore, since the focus electrode of the grid is a conductor, and the focus electrode is physically closer to the anode than the underlying gate row, the inclusion of a focusing grid may in fact aggravate flashover problems in an FED.

Another approach is to put a second gate electrode only around the pixel border. If such a "picture frame" electrode is held at a low voltage relative to the gate voltage, then there will be a focusing field deterring the electrons from straying out of the pixel area. Such an electrode introduces two problems, in addition to the obvious complexity of adding additional layers to the structure: first, there is a possibility of shorts between the two metal layers which would reduce the yield of good displays, and, second, the capacitance between the two electrodes acts as an additional load on the drivers and causes delay distortion of the gate pulses at the ends of the gate lines.

Accordingly, there is a need for methods and apparatus for reducing the horizontal dispersion of emitted electrons without adding to the complexity and expense of an FED. There is also a need for methods and apparatus which may reduce horizontal electron dispersion without reducing flashover control. The present invention meets this need, and provides other benefits as well.

OBJECTS OF THE INVENTION

It is therefore an object of the present invention to provide methods and apparatus for reducing the occurrence of flashovers in FED's.

It is another object of the present invention to provide methods and apparatus for reducing the amount of damage suffered from the occurrence of flashovers in FED's.

It is a further object of the present invention to provide methods and apparatus for dissipating excessive voltage on the gate lines in FED's.

It is still another object of the present invention to provide methods and apparatus for reducing the horizontal dispersion of electrons emitted from a field emitter.

It is yet another object of the present invention to insulate conductive elements in FED's which are susceptible to flashover.

It is still yet another object of the present invention to provide methods and apparatus which serve the dual purpose of reducing flashover and reducing the horizontal dispersion of electrons in FED's.

Additional objects and advantages of the invention are set forth, in part, in the description which follows and, in part, will be apparent to one of ordinary skill in the art from the description and/or from the practice of the invention.

SUMMARY OF THE INVENTION

In response to the foregoing challenge, Applicants have developed an innovative, economical field emitter device having a layered structure of a cathode, a first insulator, an emitter in a well of said first insulator, and a gate line overlying said first insulator, the device comprising the improvement of a second insulator layer provided over a portion of said gate line, said second insulator layer having a selective thickness such that the likelihood of flashover to or from said gate line is reduced.

Applicants have also developed an innovative and economical field emitter display comprising: a substrate; a first conductor layer provided on said substrate; a current limiter provided on said first conductor layer; an interlevel insulator layer provided on said current limiter, said interlevel insulator having a well provided in a central region thereof; an emitter provided in said well; a gate line provided on said interlevel insulator, said gate line having a hole therein above said emitter; means for insulating said gate line to reduce the occurrence of flashovers to and from said gate line; and a means for focusing emitted electrons overlying said insulating means, wherein said focusing means constitutes a resistive layer and is connected to a voltage source.

Further, Applicants have developed an innovative and economical method of making a flashover control structure for a field emitter device having a layered structure of a cathode, a first insulator layer, a group of emitters, each emitter being in a well in said first insulator layer, and a gate line overlying said first insulator layer, said method comprising the steps of: providing a layer of resist over the field emitter device; selectively removing all of said resist except for those portions overlying the group of emitters; providing a second insulator layer over the field emitter device; and lifting off portions of said resist and second insulator layer overlying the group of emitters such that the remaining second insulator layer forms a flashover control structure surrounding said group of emitters.

It is to be understood that both the foregoing general description and the following detailed description are exemplary and explanatory only, and are not restrictive of the invention as claimed. The accompanying drawings, which are incorporated herein by reference, and which constitute a part of this specification, illustrate certain embodiments of the invention, and together with the detailed description serve to explain the principles of the present invention.

DETAILED DESCRIPTION OF THE PREFERRED EMBODIMENTS

Figure 5:
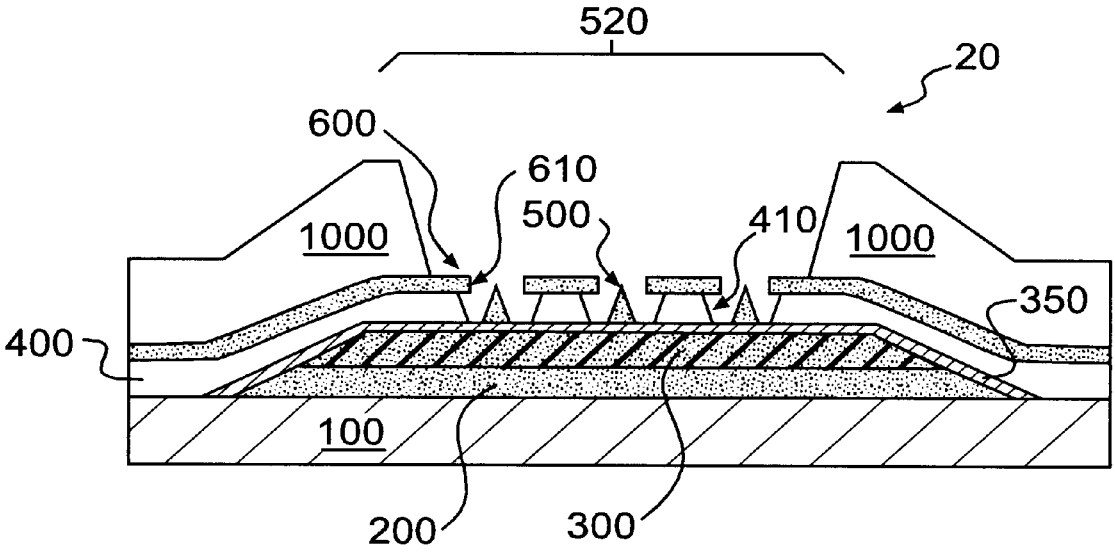
FIG. 5 is a cross sectional view in elevation of a structural embodiment of the invention.

Reference will now be made in detail to a preferred embodiment of the present invention, an example of which is illustrated in the accompanying drawings. A preferred embodiment of the present invention is shown in FIG. 5 as device 20 which may be included in a field emitter display.

Figure 1:
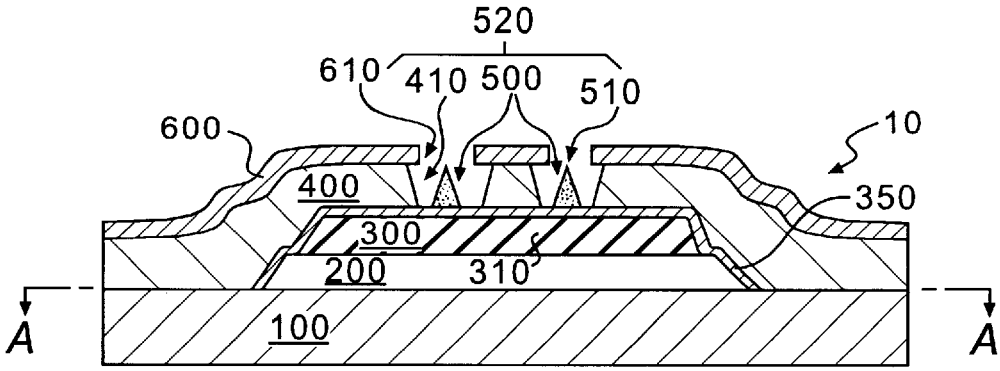
FIG. 1 is a cross-sectional view in elevation of a field emitter device.
Figure 2:
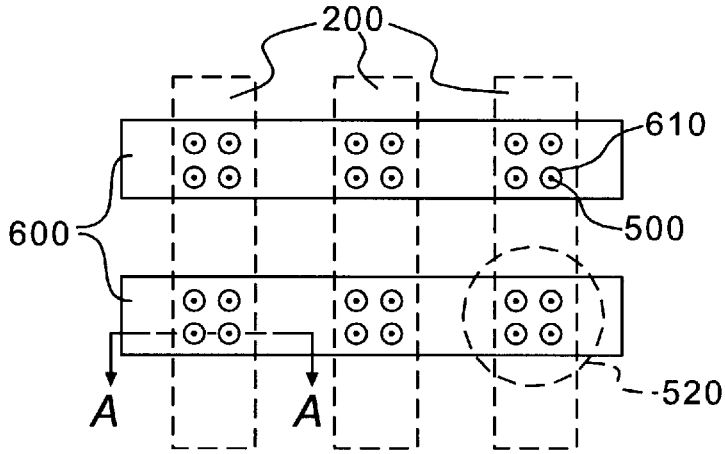
FIG. 2 is a plan view of a section of a field emitter device showing six emitter groupings comprising four emitters each.
Figure 3:
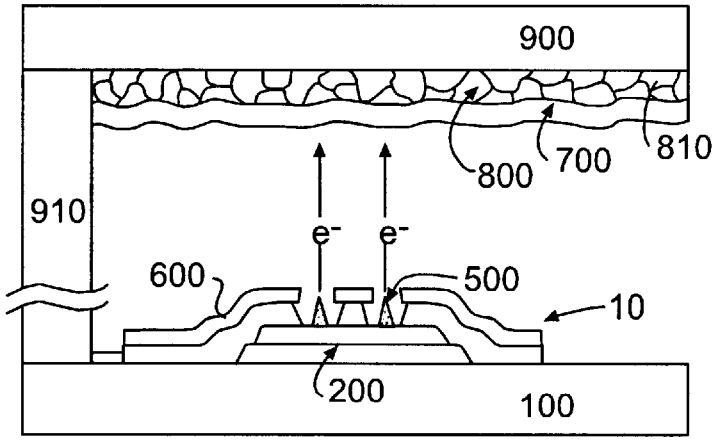
FIG. 3 is a cross-sectional view in elevation of the edge portion of a field emitter display.
Figure 4A:
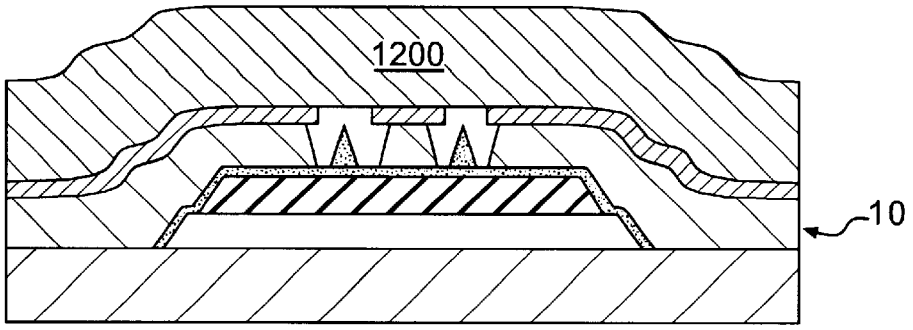
FIGS. 4*a* through 4*c* are sequential views of a representative embodiment of the inventive
Figure 4B:
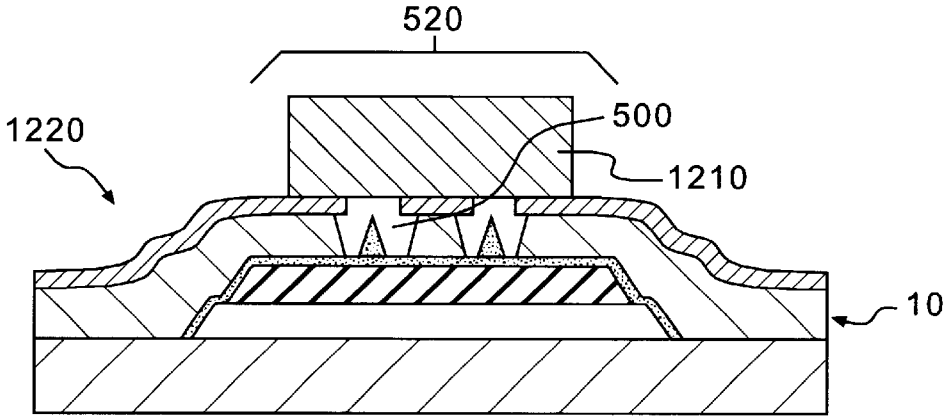

A preferred process for making device 20 (FIG. 5) may be performed starting with a field emitter device 10, shown in FIG. 1. The preferred method of making device 20 is discussed with reference to FIGS. 4*a*–4*c*, and 5. With reference to FIGS. 4*a* and 5, a resist layer 1200 may be provided on the upper surface of the device 10. In the best case, but not in all cases, the resist layer bridges the gate holes 610 so that no resist material gets into the wells 410 and fouls the emitters 500. Preferably, the resist layer may be a negative acting novalac based resist. The invention, however, may work equally well with any other positive or negative photoresist. A mask (not shown) may then be placed over the photoresist, and selective regions of the photoresist may be exposed to light through the mask. After exposure, the exposed or nonexposed regions of the photoresist may be washed away in a bath so that only a selective portion 1210 of the photoresistive layer above the emitter grouping 520 is left. With reference to FIG. 4*b*, after the bath, openings 1220 are left in the photoresist layer 1200 everywhere except over the emitter groupings 520. The openings 1220 may then be cleaned using a plasma or ion beam.

Figure 4C:
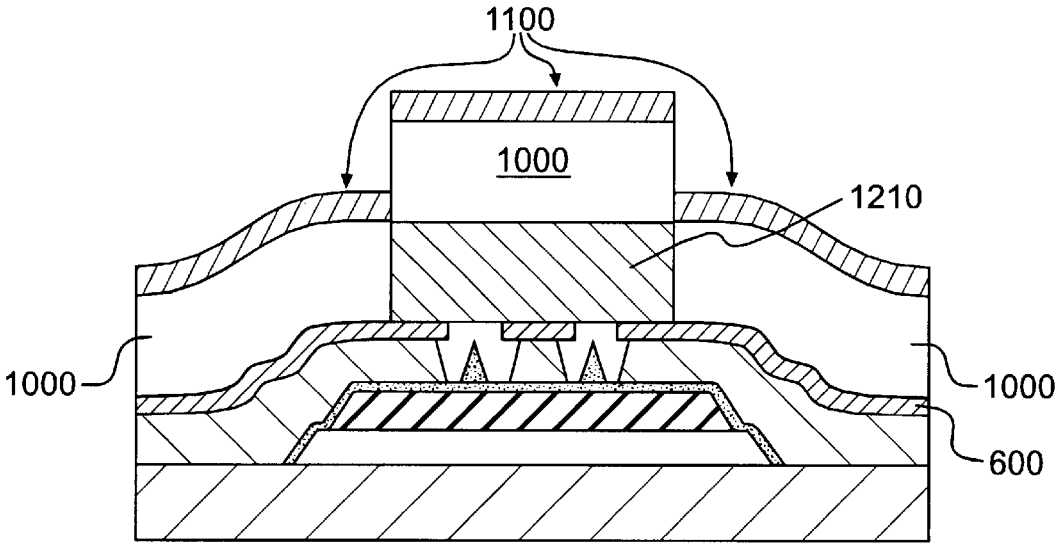

With reference to FIG. 4*c*, a surface insulator layer 1000 may then be provided over the upper surface of device 10, covering the gate layer 600 and the remaining selective portions 1210 of photoresist. Preferably, the surface insulator layer 1000 may be formed by placing the device 10 in an evaporative chamber and evaporating the insulator material onto the entire upper surface of the device. Alternatively, the surface insulator layer 1000 may be formed by a sputtering process. A chemical vapor deposition process could also be used if the material is first deposited, patterned and then etched. The chemical vapor deposition process may not be preferred because it requires exposing the emitters and gate edges to deposition and etch processes which may degrade the device performance.

The preferred evaporative deposition process for the surface insulator may be carried out at approximately room temperatures in a vacuum. The deposition process may be continued until the desired thickness of insulator material is deposited on the device 10.

The surface insulator layer 1000 may primarily comprise aluminum oxide, silicon oxide, silicon dioxide, silicon nitride, silicon carbide, a highly insulating thin film carbon, or a combination of two or more of the foregoing. For example, a surface insulator layer having a lower 500 nanometer thick silicon oxide layer and an upper 1000 nanometer thick silicon dioxide layer provides a surface layer with a good combination of step coverage, dielectric strength, and glass frit bonding ability. Multiple layered dielectrics may also be deposited (e.g., a 200 nm SiO layer under a 400 nm $SiO_2$ layer under a 10 nm 8% CrSiO layer). It is contemplated that other insulator materials may also be used without departing from the scope of the invention.

The preferred range of surface insulator layer thickness is between 0.1 and 20 microns for surface insulators provided over the interior of an FED. A surface insulator layer provided only around the outer perimeter of the FED may be as thick as 200 microns or more, and may provide even better flashover control. Insulator layers thicker than 100 microns, however, may be difficult to make (requiring screen printing processes). Accordingly, above 100 microns, there may be a trade off between added flashover control and added manufacturing complexity. With reference to FIG. 5, as a general rule the surface insulator layer 1000 preferably extends as close to the gate 610 edge as possible.

The surface insulator layer 1000 may reduce flashover between the gate lines of adjacent emitter groupings and between adjacent emitter groupings on the same gate line by surrounding the emitter groupings with insulator material. The surface insulator layer 1000 provides a physical and electrical potential barrier between adjacent gate lines and adjacent emitter groupings.

Natural charging of the surface insulator layer 1000 may also enhance electron focusing of the device 20. An explanation of the focusing effect may be provided with reference to FIG. 8, in which a corner portion of a device 20 is shown. Groupings of emitters 520 are arranged in parallel rows on gate lines 600. Each gate line 600 may correspond to a row of pixels in the "off" potential, display device, with one or more emitter groupings 520 servicing a single pixel. The display operates by applying a voltage to each of the gate lines in sequential order. The gate lines 600 are thereby "scanned" a predetermined number of times per second. The gate voltage is applied to each of the gates lines 600 for only a small portion of each scan cycle (typically there may be upwards of 480 gate lines in a VGA display). This rapid cyclical application of voltage to the gate lines 600 together with both a small amount of leakage in the insulator may result in setting the natural surface bias of the surface insulator layer 1000 to the "off" potential of the gate line because each individual gate line is only "on" for a small percentage of the time (e.g. 1/480th of the refresh time for a 480 line display). The gate lines 600 may typically be pulled to ground when they are not "on," and therefore the gate lines which are in contact with the surface insulator layer 1000 are at the gate "off" potential most of the time. The application of this gate "off" potential, results in the surface insulator layer 1000 having a negative potential relative to the charge of a gate line which is "on". If the surface insulator has a leakage time constant longer than the gate line "on" durations, then a surface potential, which provides a small degree of electron focusing in the direction normal to the gate lines, may exist on the surface insulator 1000 where it overlies inactivated gate lines.

Electron focusing enhancement may require optimization of surface insulator thickness for particular diameters of emitter groupings. For example, in one embodiment of the invention, noticeable focusing enhancement was achieved using a surface insulator layer of 1–2microns thickness, spaced 3 microns from the gate edge 610 of an emitter grouping 520, where the emitter grouping was approximately 70 microns across. NVhen the surface insulator is provided over the interior of the FED (and is in the range of 0.1 to 20 microns thick), the edge of the surface insulator may be spaced approximately 1 to 100 microns from the nearest emitters and gate line edge. When the surface insulator is provided only around the outer perimeter of the FED (and is in the range of up to 200 microns thick), the edge of the surface insulator may be spaced approximately 0.005 to 5 millimeters from the nearest emitters.

Figure 6:
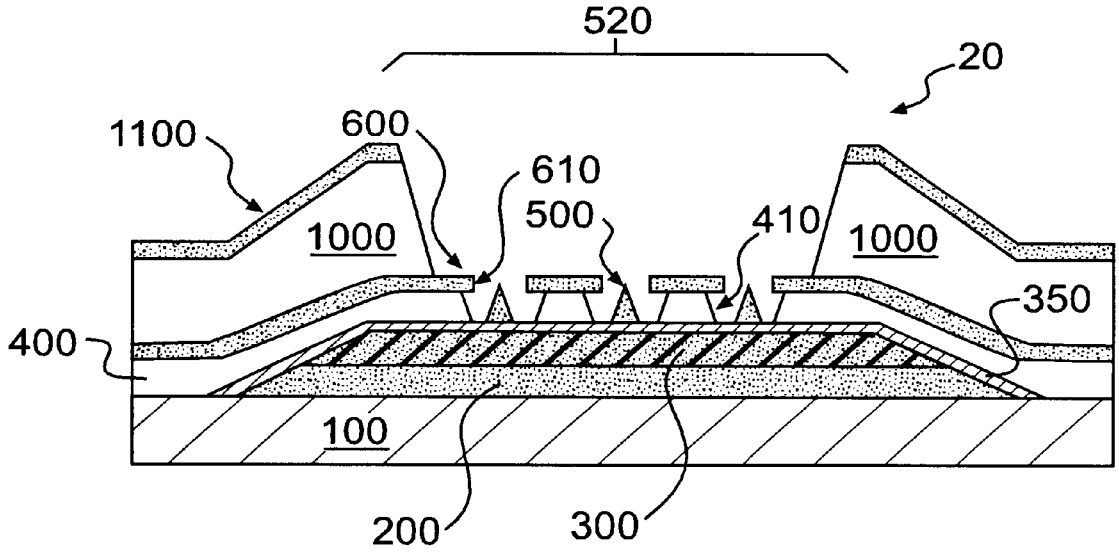
FIG. 6 is a cross sectional view in elevation of a second structural embodiment of the invention.

With reference to FIG. 6, in a preferred embodiment, the electron focusing provided by the surface insulator layer 1000 may be further enhanced by the addition of a resistive coating 1100. With renewed reference to FIG. 4*c*, in the preferred embodiment of the invention a resistive coating 1100 may be provided on the upper surface of the surface insulator layer 1000. The resistive coating 1100 may be formed by a layer of material such as a ten (10) nanometer thick layer of a 5% chromium and 95% silicon oxide mixture. The percentage weight of chromium may be varied between 2 and 20 percent to vary the resistive quality of the coating 1100. In a preferred embodiment the percentage of chromium may be between 5 and 10 percent. The preferred embodiment of the resistive coating 1100 may have a sheet resistance of greater than 1 G-ohms per square. In alternative embodiments, the resistive coating 1100 may comprise a thin film of N or P lightly doped silicon, undoped silicon, or chromium oxide. The resistive coating may preferably be formed by an evaporation process; and in the alternative may be formed by sputtering or by chemical vapor deposition. If the resistive layer is tied to a voltage lower than the "off" voltage for the gates, for example 20 V or more lower, then the focusing action will be much more effective, and it will apply to both vertical and horizontal directions.

Figure 12:
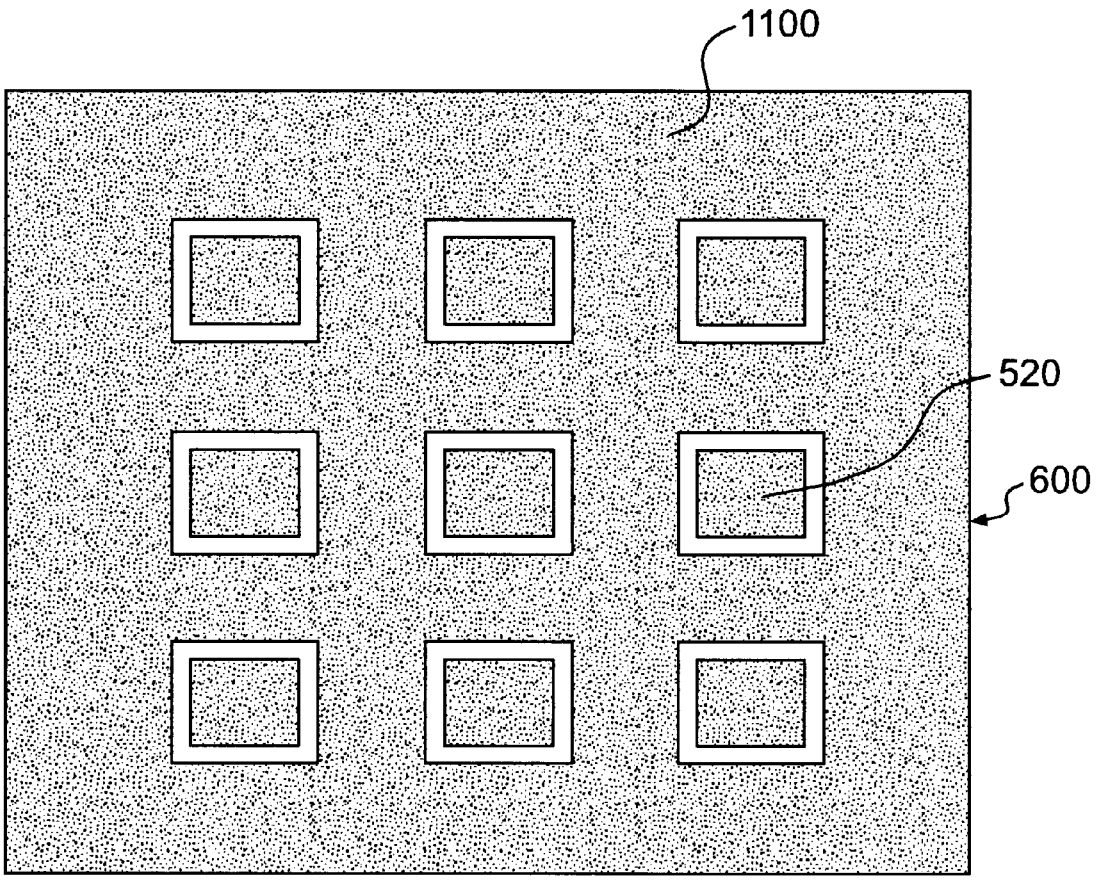
FIG. 12 is a plan view of an FED with a resistive layer surrounding emitting areas.
Figure 13:
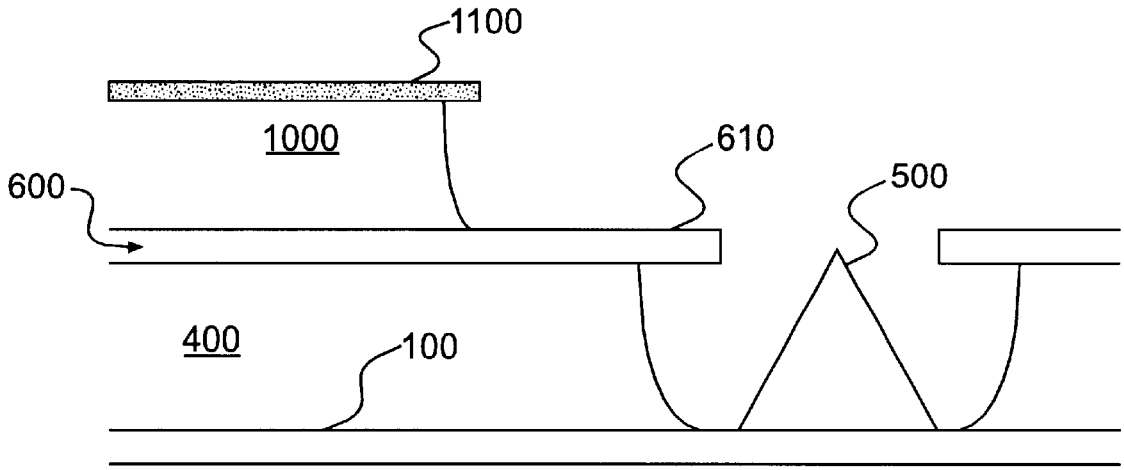
FIG. 13 is a cross-sectional view in elevation of a FED with the resistive layer of FIG. 12.
Figure 14:
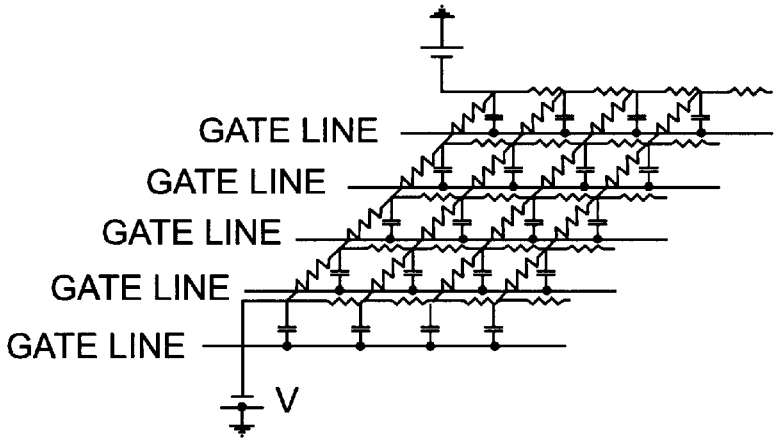
FIG. 14 is a schematic of the circuit equivalent of the FED with a resistive layer of FIG.

With reference to FIGS. 12 and 13, what is proposed is to use a "picture frame" insulator structure around each pixel, i.e. around a group of emitters 520, where the insulator is covered by a resistive layer 1100 which is sufficiently conducting to allow charge to flow onto the surface of the insulator 1000, but resistive enough to prevent a significant flow of charge in the short time of a gate pulse and resistive enough to minimize the impact of a short circuit to the gate electrode 610.

If the resistive layer 1100 is connected to a low dc voltage, such that with the addition of the gate voltage pulse it would still provide focusing, then during the row selection period the potential of the surface will increase by the same amount as the gate voltage pulse, provided that the sheet resistivity is high enough, and the surface potential will still provide focusing. In the vertical direction, where the resistive layer 1100 lies over gate lines 600 which are at a lower voltage, there will be even stronger focusing, determined by the dc voltage on the resistive layer 1100. Thus, at the time when the pixel is emitting, the picture frame around the emitting region 520 will have two sides at the dc potential of the resistive layer 1100, and two sides at the dc potential plus the gate select voltage increment. Assuming either voltage will provide focusing, the result will be a slightly astigmatic focusing system with stronger vertical focusing than horizontal.

The required resistivity can be estimated by looking at the resistive layer/insulator gate electrode as an RC transmission line. At t=0, there is an increment voltage $\Delta V_G$ between x=w/2 and x=w/2. Each fourier component of this impulse decays at a rate proportional to the square of the spatial frequency. The important components have frequencies less than $\pi/w$, which leads to a maximum rate of decay of $d\sigma\pi^2/\epsilon w^2$, where d is the thickness of the insulator, $\epsilon$ is the dielectric constant of the insulator 1000, and C is the sheet conductance of the resistive layer 1100. We would want the decay time to be more than ten times the width of the gate pulse, so that the potential at the surface of the period T and for a display with N rows, the pulse width is T/N, and the decay time needs to be more than 10 T/N. This leads to the requirement that:

$$\sigma<\epsilon W^2N/10d\pi^2T$$

A more exact simulation yields a value only two times smaller, so this simple estimate works remarkably well.

For typical values of these parameters, the sheet conductance needs to be less than $10^{-9}$ Siemens/square. In terms of sheet resistivity, the value must be greater than $10^{9}$ Ohms/square. If the resistive layer 1100 is 10 nm thick, than the resistivity must be greater than about $10^{3}$ Ohm-cm. This is achievable for a variety of materials, some of which are already used in the fabrication of field emission devices.

Figure 7:
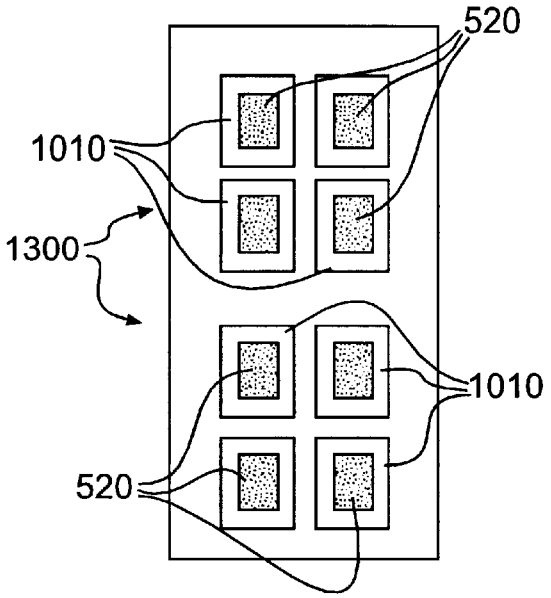
FIG. 7 is a plan view of plural emitter groupings surrounded by insulator structures of an embodiment of the invention.

FIG. 7 is a plan view of eight emitter groupings 520 which provide the electron emissions for two display screen picture elements 1300. Each emitter grouping 520 may contain hundreds or thousands of individual emitters. Each grouping 520 may also be surrounded by an insulator structure 1010. The insulator structures 1010 may comprise the surface insulator layer 1000, shown in FIGS. 5 or 6. The insulator structure 1010 may prevent flashover between adjacent emitter groupings 520, and/or between emitter groupings of adjacent picture elements 1300.

Figure 8:
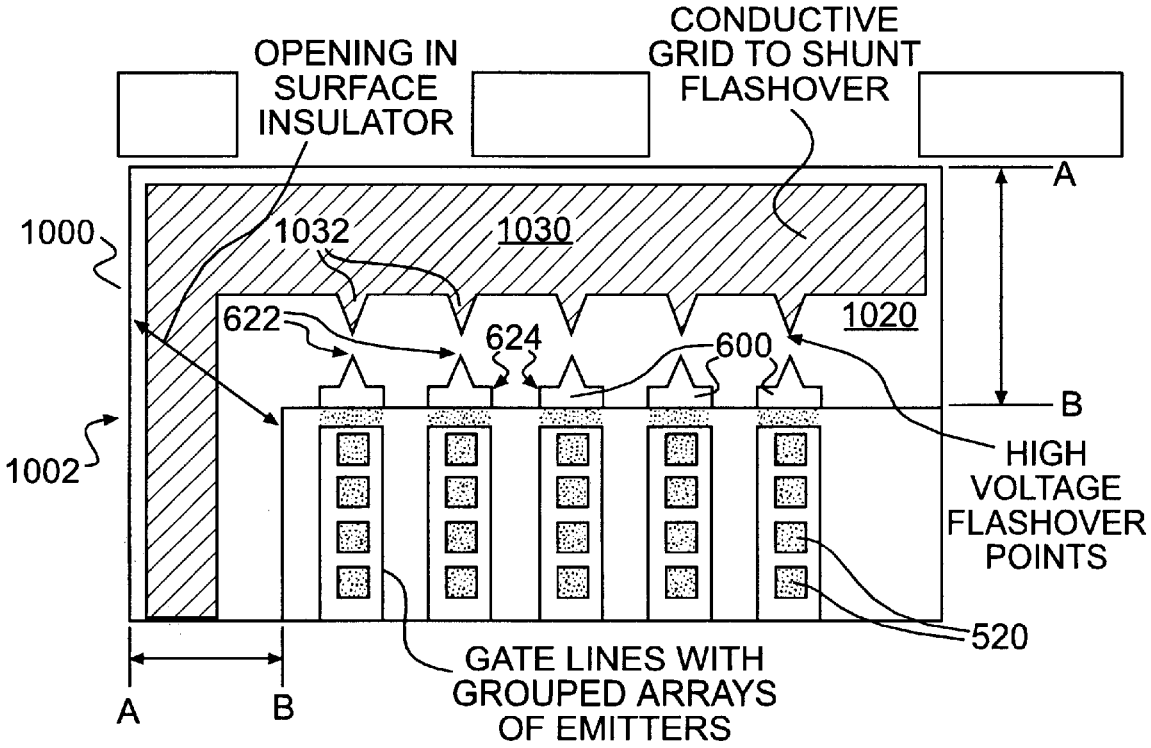
FIG. 8 is a plan view of a corner section of a field emitter device of an embodiment of the invention.

With reference to FIG. 8, in another preferred embodiment of the invention an insulator well may be provided around the entire display screen, or around a significant portion of the screen. The insulator well may be constructed by providing a surface insulator layer 1000 over the device panel containing all of the emitter groupings 520 for the display screen. A section of the display screen periphery is shown in FIG. 8. The surface insulator layer 1000 may then be selectively removed between the points A and B to create a trough region 1020. The ends of the gate lines 600 may be exposed as a result of the formation of the trough region 1020. The width of the surface insulator 1000 between the emitter grouping closest to the ends of the gate lines 600 and the ends of the gate lines themselves may be substantially greater than shown in FIG. 8, relative to the widths of surface insulator material shown elsewhere in FIG. 8.

A flashover protection grid, or shunt, 1030 may be provided within the trough region 1020. The flashover protection grid 1030 may be provided by a grounded line comprised of the same metal (e.g. chromium, aluminum, molybdenum, niobium, nickel) as the gate lines 600. Alternatively the protection grid 1030 may be provided by any other metal or conductor which will adhere to the glass substrate or interlevel insulator layer. The protection grid 1030 may be in the range of 0.1 to 20 microns thick, and between 50 micrometers and 10 millimeters wide. Protection grid thicknesses in the range of 20 microns thick may be obtained by thick film paste screen-on grids. The gate lines 600 may preferably transfer flashover power to the protection grid 1030 instead of flashing over to another gate line. Flashover from a gate line 600 to the protection grid 1030 may be harmlessly dissipated to ground, thereby preventing one gate line flashover from disrupting the operation of neighboring gate lines.

Figure 9:
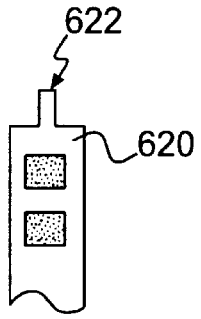
FIG. 9 is a plan view of an alternative gate line end to those shown in FIG. 8.

The ends 622 of the gate lines 600 may be pointed in the direction of the protection grid 1030 to facilitate shunt flashover from the gate lines to the protection grid. The protection grid 1030 may also include pointed features 1032 to facilitate flashover thereto. The ends 622 and the features 1032 need not come to a sharp point, alternatively the ends and features may be provided by any shape which includes a sharp corner which points generally in the direction in which flashover is desired (see FIG. 9). With continued reference to FIG. 8, the sharp comers 624 of the ends of the gate lines 600 may facilitate simultaneous shunt flashover between two or more neighboring gate lines and the protection grid 1030. By providing sharp cornered ends 622 on the gate lines 600 terminating inside the display, and exposing the surface of the gate line ends through the inner portion of the flashover insulator layer 1000, flashovers may be spread to plural of the adjacent gate lines. The intensity of a single flashover may thereby be spread amongst the plural gate lines, reducing the impact the flashover has on any one gate line. Because most flashovers in field emitter devices involve the gate line voltage going positive, flash points on the protection grid are usually sufficient to insure proper operation of the grid 1030 as a conductive shunt.

Figure 11:
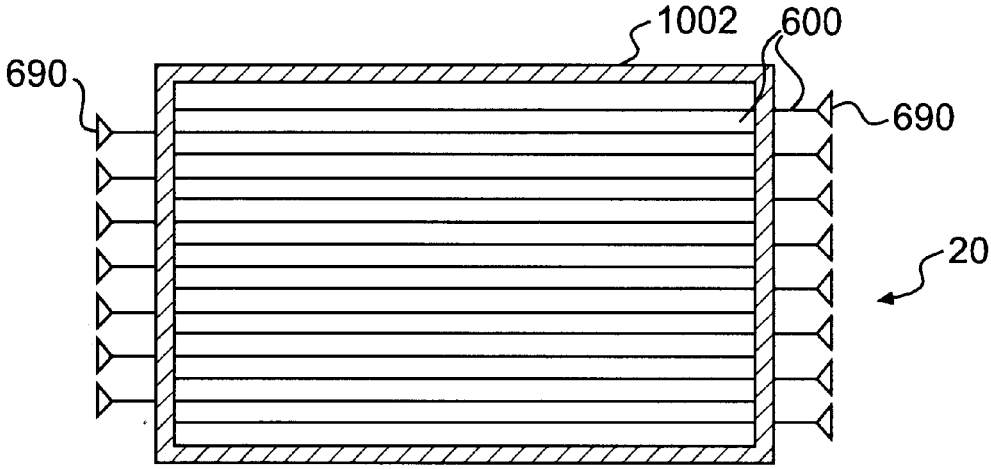
FIG. 11 is a plan view of an FED with interdigitated gate lines and an outer perimeter of insulator material.

With continued reference to FIG. 8, the outer perimeter 1002 of the surface insulator layer 1000 may prevent flashovers from the protection grid 1030 and the gate lines 600 to the conductors outside the outer perimeter 1002. The outer perimeter 1002 also provides a potential well which surface electron flashovers (originating from outside of the outer perimeter 1002) must cross to reach the gate lines 600 in the display. With reference to FIG. 11, an FED 20 may be provided with a surface insulator only at the outer perimeter 1002. When the surface insulator is provided only at the outer perimeter 1002 it may be on the order of 100 to 200 microns thick and provided by a screen printing process, The outer perimeter 1002 of insulator material may prevent flashover between gate lines 600 in the outer perimeter and gate lines which extend outside the outer perimeter. The alternating driver 690 arrangement of an interdigitated FED is also illustrated in FIG. 11.

The foregoing combination of pointed, or sharp cornered gate line ends 622 and a surrounding protection grid or shunt 1030 may provide flashover control even if the outer perimeter 1002 is not provided. If this embodiment is employed, the potential well provided by the outer perimeter 1002 is only electrical, rather than being both electrical and physical, as is the case when the outer perimeter is added to the combination.

As with the surface insulator layer shown in FIG. 6, a conductive or moderately resistive coating or film 1100 may be provided on the surface insulator layer 1000 shown in FIG. 8. The coating 1100 may be biased to ground or to a selected focusing voltage to provide enhanced electron focusing.

Figure 10:
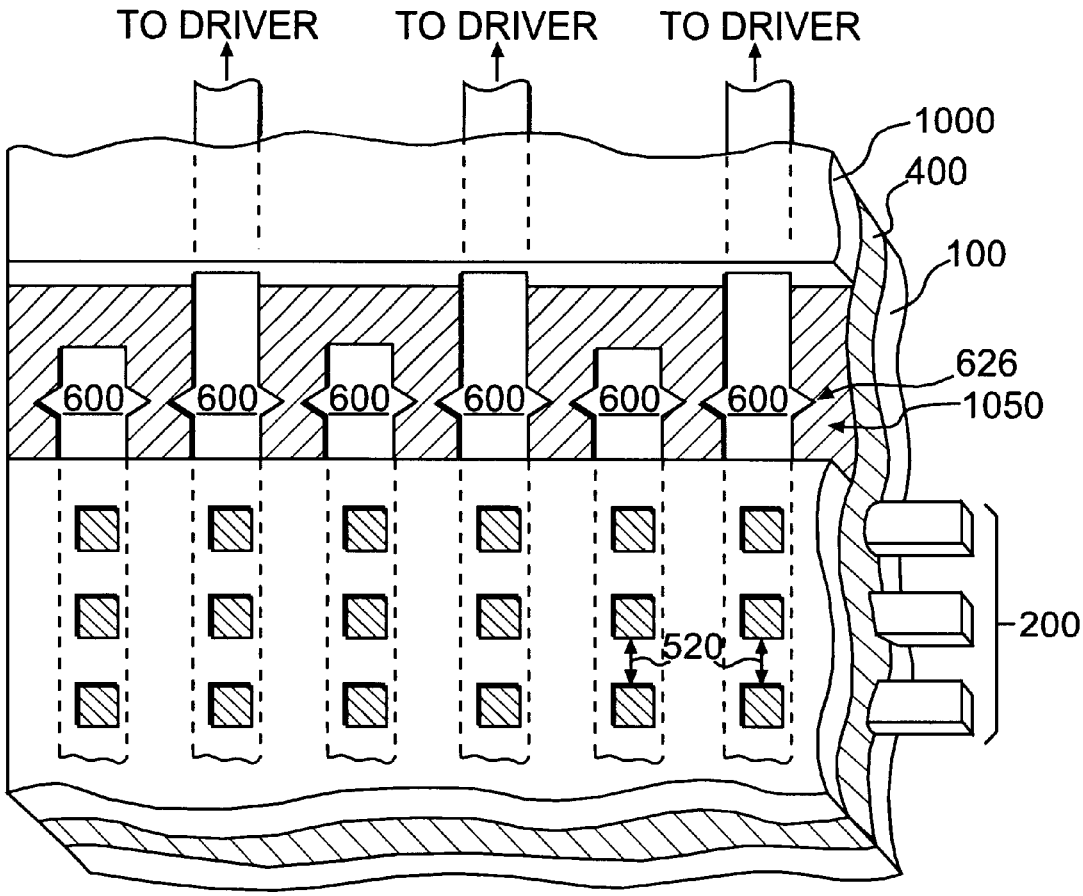
FIG. 10 is a pictorial view of a portion of a field emitter device of an embodiment of the invention.

With reference to FIG. 10, flashover control may also be provided between interdigitated gate lines 600. Each of the gate lines 600 of the FED 20 may be driven by a separate driver (not shown). The gate lines 600 may be arranged such that the driver for every other gate line is provided at the same end of the FED. For example, in the FED shown in FIG. 10, starting from the left, the first, third, and fifth gate lines 600 may have drivers at the lower end of the FED, and the second, fourth, and sixth gate lines may have drivers at the upper end of the FED. A channel 1050 may be provided in the surface insulator layer 1000 running across the ends of the first, third, and fifth gate lines 600. The gate lines 600 may include pointed, or otherwise shaped, projections 626 extending laterally from each gate line in the direction of a neighboring gate line.

The projections 626 may facilitate the spreading of excess positive charge over several of the gate lines 600 and thereby reduce the sensitivity of the FED 20 to electrostatic discharge and/or other excess voltages (such as flashovers). By spreading out excess charge over plural gate lines, the arrangement shown in FIG. 10 may reduce the level of damage sustained by a single gate line from a flashover or electrostatic discharge. If the power per unit area of the flashover event is distributed over a larger area, damage may be eliminated or greatly reduced. This arrangement may have particular applicability in an FED in which access to an external ground shunt is not practical, as may be the case when interdigitated driver connections are used.

It will be apparent to those skilled in the art that various modifications and variations can be made in the construction, configuration, and/or operation of the present invention without departing from the scope or spirit of the invention. For example, in the embodiments mentioned above, various changes may be made to the materials used for the surface insulator layer and the resistive coating. Variations in the shapes and sizes of the emitters, emitter groupings and gate lines may also be made without departing from the scope and spirit of the invention. Further, it may be appropriate to make additional modifications or changes to the process for adding the surface insulator layer and resistive coatings without departing from the scope of the invention. Thus, it is intended that the present invention cover the modifications and variations of the invention provided they come within the scope of the appended claims and their equivalents.

We claim:

1. In a field emitter device having a layered structure of a cathode, a first insulator, an emitter in a well of said first insulator, and a gate line overlying said first insulator, the improvement comprising:

a second insulator layer provided over a portion of said gate line, said second insulator layer having a selective thickness such that the likelihood of flashover to or from said gate line is reduced, wherein said second insulator layer surrounds a grouping of two or more emitters, and wherein said second insulator layer covers said gate line except for a portion of said gate line intermediate of said two or more emitters.

2. In a field emitter device having a layered structure of a cathode, a first insulator, an emitter in a well of said first insulator, and a gate line overlying said first insulator, the improvement comprising:

a second insulator layer provided over a portion of said gate line, said second insulator layer having a selective thickness such that the likelihood of flashover to or from said gate line is reduced, and wherein said second insulator layer surrounds a grouping of two or more emitters and includes a gap near an outer perimeter of said field emitter device.

3. The field emitter device of claim 2 further comprising a means for shunting a charge to ground disposed in said gap.

4. The field emitter device of claim 3 wherein said shunting means comprises conductor selected from the group consisting of: chromium, aluminum, molybdenum, niobium, and nickel.

5. The field emitter device of claim 3 further comprising a conductive extension from said shunting means in the vicinity of an end of said gate line.

6. The field emitter device of claim 5 wherein said conductive extension includes a sharp point in the vicinity of the gate line end.

7. The field emitter device of claim 3 further comprising a conductive extension from said gate line in the vicinity of said shunting means.

8. The field emitter device of claim 7 wherein said conductive extension includes a sharp point in the vicinity of the shunting means.

9. The field emitter device of claim 7 wherein said conductive extension includes plural sharp points.

10. In a field emitter device having a layered structure of a cathode, a first insulator, an emitter in a well of said first insulator, and a gate line overlying said first insulator, the improvement comprising:

a second insulator layer provided over a portion of said gate line, said second insulator layer having a selective thickness such that the likelihood of flashover to or from said gate line is reduced; and a resistive layer overlying said second insulator layer.

11. The field emitter device of claim 10 wherein said resistive layer is approximately 10 nanometers thick.

12. The field emitter device of claim 10 wherein said resistive layer has a resistivity greater than $10^8$ ohms/square.

13. The field emitter display of claim 10 wherein said resistive layer comprises a material selected from the group consisting of: (i) a mixture of chromium and silicon oxide, (ii) N or P lightly doped silicon, (iii) undoped silicon, and (iv) chromium oxide.

14. The field emitter display of claim 13 wherein said mixture of chromium and silicon oxide comprises between 2% and 20% chromium by weight.

15. A field emitter display, comprising:

a substrate;

a first conductor layer provided on said substrate;

a current limiter provided on said first conductor layer;

an interlevel insulator layer provided on said current limiter, said interlevel insulator having a well provided in a central region thereof;

an emitter provided in said well;

a gate line provided on said interlevel insulator, said gate line having a hole therein above said emitter;

means for insulating said gate line to reduce the occurrence of flashovers to and from said gate line, said means being greater than about 600 nanometers thick; and further comprising a resistive layer for focusing emitted electrons overlying said insulating means, wherein said resistive layer is connected to a voltage source.

16. In a field emitter display having emitter arrays associated with a gate line provided on a first insulator layer, the improvement comprising a means for reducing flashover overlying said gate line in areas surrounding each said emitter array, wherein said means for reducing flashover comprises:

an inner second insulator layer covering said gate line except in the region of a gate line end and the regions of said emitter arrays;

an outer second insulator layer surrounding an outer perimeter of said inner insulator layer, said outer second insulator layer being spaced from said inner second insulator layer to form a gap region therebetween such that said gate line end extends into the gap region; and a means for shunting electricity from said gate line to ground, said shunting means being provided in said gap region and being selectively spaced from said gate line end.

17. The field emitter display of claim 16 wherein said shunting means includes an extension of conductive material in the vicinity of the end of said gate line.

18. The field emitter display of claim 17 wherein said gate line end includes a sharp point pointed in the direction of said extension.

19. The field emitter display of claim 16 wherein said gate line end includes a sharp point pointed in the direction of said shunting means.

* * * * *